United States Patent [19]

Welden et al.

[11] 3,944,142

[45] Mar. 16, 1976

[54] SPLIT STREAM BURNER ASSEMBLY

[75] Inventors: Robert P. Welden, Westfield; Lawrence V. O'Connor, Morristown, both of N.J.

[73] Assignee: Foster Wheeler Energy Corporation, Livingston, N.J.

[22] Filed: Mar. 22, 1974

[21] Appl. No.: 453,754

[52] U.S. Cl. ..... 239/552; 239/553; 239/568

[51] Int. Cl.[2] ..... B05B 1/06

[58] Field of Search ..... 239/552, 553, 568, 597, 239/601, 553.5, 424, 424.5

[56] References Cited

UNITED STATES PATENTS

| | | | |
|---|---|---|---|
| 449,315 | 3/1891 | Elwood | 239/399 |
| 745,872 | 12/1903 | Machlet | 239/552 |
| 1,885,067 | 10/1932 | Woodeson | 431/185 |
| 2,301,017 | 11/1942 | Cherry | 432/25 |
| 2,391,934 | 1/1946 | White | 239/552 |
| 3,556,410 | 1/1971 | Arant | 239/552 |
| 3,640,472 | 2/1972 | Hruby | 239/552 |

*Primary Examiner*—Carroll B. Dority, Jr.
*Attorney, Agent, or Firm*—Marvin A. Naigur; John E. Wilson

[57] ABSTRACT

A burner assembly in which pulverized solid fuel passing through the burner housing is divided into a plurality of streams, which, upon combustion, produce a plurality of flame patterns to reduce the formation of nitric oxides.

3 Claims, 4 Drawing Figures

SPLIT STREAM BURNER ASSEMBLY

BACKGROUND OF THE INVENTION

This invention relates to a burner assembly and, more particularly, to an improved burner assembly which operates in a manner to reduce the formation of nitric oxides as a result of fuel combustion.

A great deal of attention has recently been directed to the reduction of nitric oxides resulting from the combustion of fuel, and especially in connection with the furnace sections of relatively large installations such as vapor generators and the like.

In these type of arrangements, one or more burners are usually disposed in communication with the interior of the furnace and operate to combust pulverized solid fuel in air. The burners used in these arrangements are generally the type in which a swirling fuel-air mixture is continuously injected through a single nozzle so as to form a relatively large and single flame. As a result, the surface area of the flame is relatively small as compared to its volume and therefore the average flame temperature is relatively high. This condition, in turn, leads to the production of high levels of nitrogen oxides in the final combustion products which cause severe air pollution problems.

Although several attempts have been made to suppress the formation of nitric oxides, including techniques involving two stage combustion and flue gas recirculation, they often result in added expense in terms of contruction costs, etc., and lead to other related problems, such as the production of soot.

SUMMARY OF THE INVENTION

It is, therefore, an object of the present invention to provide a burner assembly in which the level of nitric oxides is considerably reduced without any significant increase in costs, or other related problems.

It is a more specific object of the present invention to provide a burner assenbly in which the surface area of the flame per unit volume is increased which results in a greater flame radiation, a lower flame temperature, and a shorter residence time of the gas components within the flame at maximum temperature, all of which contribute to reduce the formation of nitric oxides.

Towards the fulfillment of these and other objects, the burner assembly of the present invention comprises a housing adapted to receive a fuel, means in said housing for defining an annular flow path for said fuel through said housing, said flow path terminating in an annular discharge opening, and means disposed in said annular discharge opening for splitting up the fuel discharge from said opening so that, upon ignition of said fuel, a plurality of flame patterns are formed.

DESCRIPTION OF THE PREFERRED EMBODIMENTS

Figure 1:
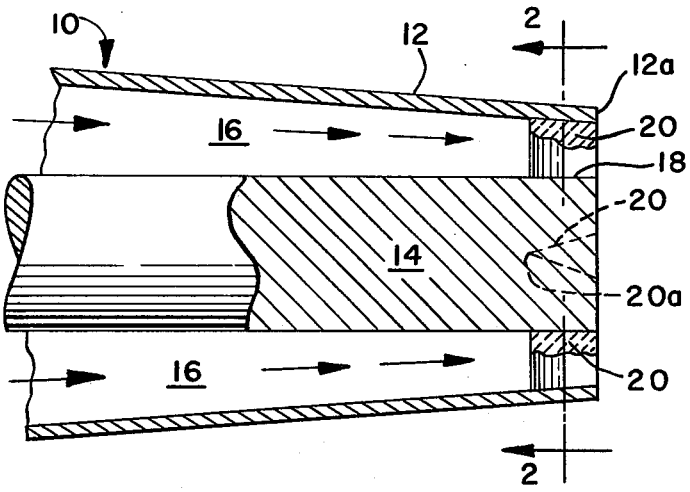
FIG. 1 is a longitudinal cross-sectional view depicting the burner assembly of the present invention.
Figure 2:
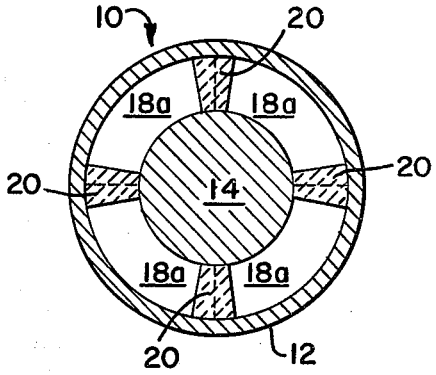
FIG. 2 is a cross-sectional view taken along the line 2—2 of FIG. 1.

Referring specifically to FIGS. 1 and 2 of the drawings, the reference numeral 10 refers in general to the burner assembly of the present invention which comprises a tubular housing 12 shown partially and adapted to receive fuel at one end thereof (not shown). A rod 14 is disposed concentrically within the housing 12 and, together with the inner wall of the housing, defines an annular flow path 16 through which the fuel passes in a direction shown by the solid arrows. The housing 12 is tapered slightly toward its discharge end **12*a* and the corresponding end of the rod 14 extends flush therewith to define an annular discharge opening 18.**

A plurality of splitters, or posts 20, are equally spaced around the discharge opening 18. A typical arrangement would include four posts at ninety degree intervals to define a plurality of arcuate openings **18*a* as shown in FIG. 2. The posts 20 may be fastened relative to the housing 12 and the rod 14** in any conventional manner such as by welding.

As shown in FIG. 1, the posts 20 are tapered in cross-section with the relatively narrow end, or edge, **20*a* of each post facing upstream with respect to the flow path 16** to facilitate the splitting of the fuel.

Figure 3:
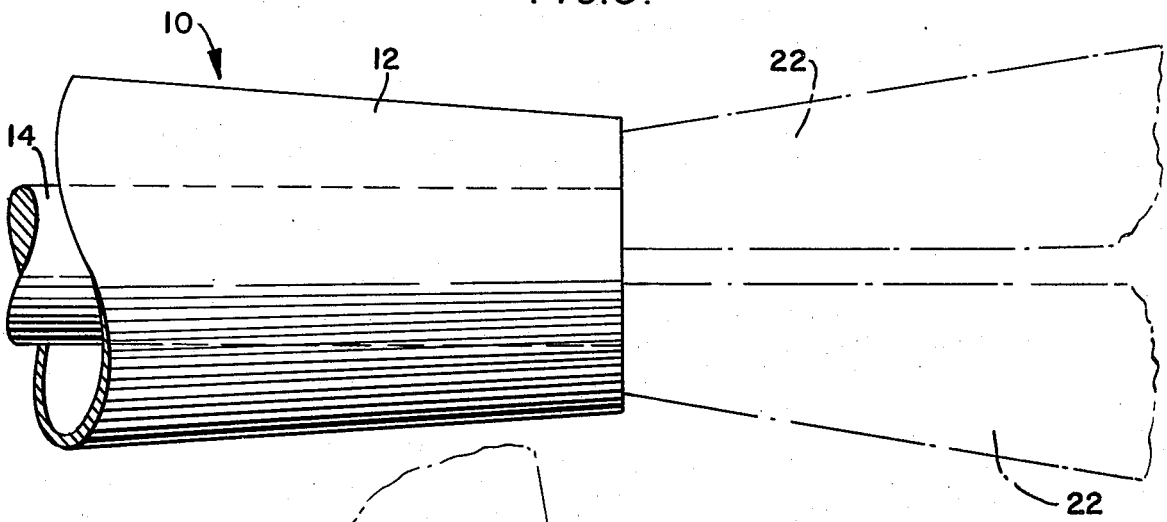
FIGS. 3 and 4 are schematic elevational views of the assembly of FIGS. 1 and 2 and depicting the flame patterns produced.
Figure 4:
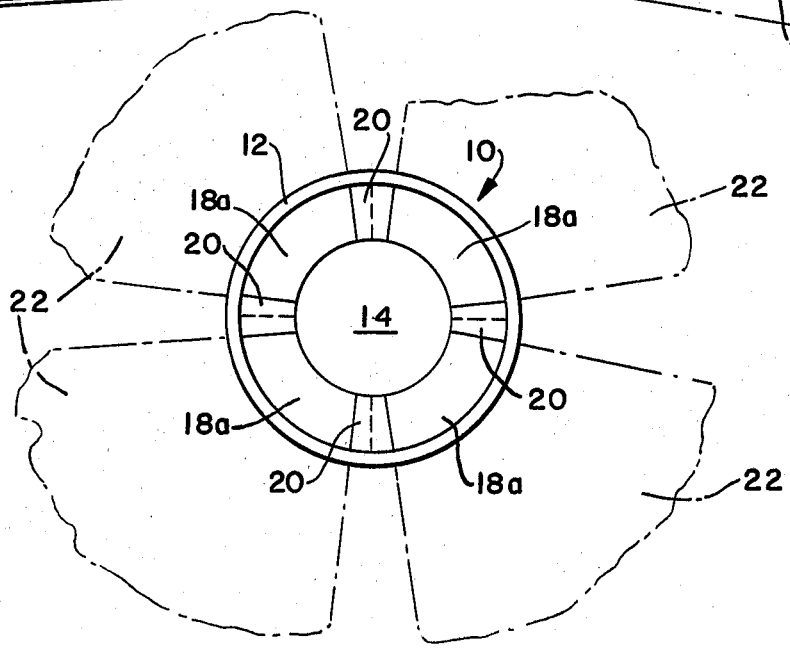

In operation, a fuel such as an appropriate mixture of pulverized coal and primary air is emitted into the housing 12 and passes along the annular flow path 16 between the inner wall of the housing 12 and the outer surface of the rod 14 until it reaches the discharge opening 18. At this point the fuel is divided, or split up into multiple streams by the posts 20 and, upon being ignited in any conventional manner, forms the individual flame patterns shown by the reference numerals 22 in FIGS. 3 and 4. It is noted that the flame patterns 22 are substantially arcuate shaped as they emit from the discharge openings **18*a*** and diverge outwardly from the latter openings.

This splitting up of the flame patterns results in a greater flame radiation, a lower average flame temperature and a shorter residence time of the gas components within the flame at maximum temperature all of which, as stated above, continue to reduce the formation of nitric oxides.

It is understood that several variations may be made in the foregoing without changing the scope of the invention. For example, the shape and size of the posts 20 may be varied along with their number and relative spacing around the discharge opening 18. Also, the type of fuel may be varied.

Of course, other variations of the specific construction and arrangement of the burner assembly disclosed above can be made by those skilled in the art without departing from the invention as defined in the appended claims.

What is claimed is:

1. A burner assembly comprising a housing adapted to receive a fuel, a rod extending within said housing for defining an annular flow path for said fuel through said housing, said flow path terminating in an annular discharge opening, and a plurality of posts extending between said housing and said rod and spaced around said annular discharge opening for splitting up the fuel discharging from said opening so that, upon ignition of said fuel, a plurality of flame patterns are formed, each of said posts having a triangular cross-section with a base of said triangle extending substantially flush with the discharge end of said housing and with an angle of said triangle extending in said flow path upstream from said base.

2. The assembly of claim 1 wherein said posts define a plurality of arcuate discharge openings, the arcuate lengths of which are greater than the arcuate lengths of said posts.

3. The assembly of claim 1 wherein said housing is tapered in a manner so that the cross-sectional area of said flow path decreases in a direction towards said discharge opening.

* * * * *